US006128988A

United States Patent [19]

Hillebrand et al.

[11] Patent Number: 6,128,988

[45] Date of Patent: Oct. 10, 2000

[54] APPARATUS FOR MOVING POINT NEEDLES

[75] Inventors: Bernd Anton Hillebrand, Bergrheinfeld; Horst Bernhard Michalik, Höchberg, both of Germany

[73] Assignee: Koenig & Bauer-Albert Aktiengesellschaft, Wurzburg, Germany

[21] Appl. No.: 09/135,177

[22] Filed: Aug. 18, 1998

Related U.S. Application Data

[62] Division of application No. 08/621,434, Mar. 25, 1996, Pat. No. 5,765,459.

[30] Foreign Application Priority Data

Mar. 25, 1995 [DE] Germany ..... 195 11 053

[51] Int. Cl.[7] ..... B26D 1/01

[52] U.S. Cl. ..... 83/115; 83/154; 83/423; 83/436.1

[58] Field of Search ..... 83/154, 436.1, 83/410.7, 410.8, 409; 101/411, 410, 409; 270/42, 50; 271/277, 3.24; 493/431, 432

[56] References Cited

U.S. PATENT DOCUMENTS

| | | | |
|---|---|---|---|
| 100,367 | 3/1870 | Bullock | 83/154 |
| 1,177,933 | 4/1916 | Dausman | 101/411 |
| 1,185,088 | 5/1916 | Goss | 496/426 |
| 1,578,436 | 3/1926 | Herb | 493/427 |
| 1,717,257 | 6/1929 | Rasmussen | 493/428 |
| 1,784,757 | 12/1930 | Scott | 493/427 |
| 1,816,947 | 8/1931 | Wood | 493/427 |
| 1,829,243 | 10/1931 | Smith | 493/431 |
| 1,831,220 | 11/1931 | Wood | 493/427 |
| 1,868,125 | 7/1932 | Tomlin | 483/167 |
| 2,031,780 | 2/1936 | Lamatsch | 493/360 |
| 2,318,953 | 5/1943 | Meyer | 83/154 |
| 2,555,267 | 5/1951 | Crafts | 493/429 |
| 2,797,084 | 6/1957 | Hilgoe . | |
| 3,593,606 | 7/1971 | Raybuck | 83/154 |
| 3,606,308 | 9/1971 | Mowry et al. | 271/277 |
| 3,758,102 | 9/1973 | Munn et al. | 493/432 |
| 4,190,242 | 2/1980 | Bolza-Schunemann | 270/50 |
| 4,290,595 | 9/1981 | Thünker | 271/277 |
| 4,368,879 | 1/1983 | Hoshi | 493/432 |
| 4,437,855 | 3/1984 | Bullen | 493/427 |
| 4,496,338 | 1/1985 | Michalik | 493/367 |
| 4,892,036 | 1/1990 | Lange | 101/240 |
| 4,909,150 | 3/1990 | Leyendecker et al. | 271/277 |
| 5,427,005 | 6/1995 | Breton | 83/154 |
| 5,503,071 | 4/1996 | Hillebrand et al. | 101/411 |

FOREIGN PATENT DOCUMENTS

| | | |
|---|---|---|
| 138846 | 8/1899 | Germany . |
| 1 074 057 | 1/1960 | Germany . |
| 29 25 376 | 1/1981 | Germany . |
| 38 10 10439 | 8/1989 | Germany . |
| 6-115807 | 4/1994 | Japan . |

*Primary Examiner*—M. Rachuba
*Attorney, Agent, or Firm*—Jones, Tullar & Cooper, P.C.

[57] ABSTRACT

Point needles in a conveying cylinder of a rotary press are caused to follow a curve course which securely fastens a web to the cylinder while eliminating transport damage to the printed products as well as reducing paper waste. The needle tips of the point needles are moved along their path by the superimpositioning of two pivot movements, one of which is accomplished by a point holder arm and the second of which is accomplished by a rocker. The two cooperate to form a level four member swivel joint.

9 Claims, 3 Drawing Sheets

APPARATUS FOR MOVING POINT NEEDLES

This is a divisional application of Ser. No. 08/621,434, filed Mar. 25, 1996, now U.S. Pat. No. 5,765,459.

FIELD OF THE INVENTION

The present invention is directed generally to a method and apparatus for moving point needles. More particularly, the present invention is directed to a method and apparatus for moving point needles fastened in point needle holders in a conveying cylinder. Most specifically, the present invention is directed to a method and apparatus for moving point needles in a conveying cylinder of a rotary printing press to needle a paper web. The point needles pierce a web-shaped product prior to its being cut into signatures by a cutter. These point needles are arranged in point needle holders which are supported by movable, controllable point holder arms. The point needles are caused to extend out beyond the periphery of the conveying cylinder in a curved course due to the provision of a rocker which is connected to the point needle holder and which forms a four member swivel joint in conjunction with the point holder arm. A cylinder which is usable to convey signatures is also part of the present invention.

DESCRIPTION OF THE PRIOR ART

In the production of various folded printed products in a rotary web-fed printing press, a continuous web of material to be printed, such as a paper web, is printed by passing through one or more printing couples. After the web has been printed, it may be associated with other printed webs and may then be longitudinally folded. The still continuous length web is then cut transversely to its direction of travel into discrete lengths by the operation of a cutting blade that cooperates with a collecting and folding blade cylinder. This collecting and folding blade cylinder is also provided with a plurality of gripping devices that engage the newly created leading edge of the web just upstream of the cutting point, and that hold the newly severed signatures on the periphery of the collecting and folding blade cylinder until these signatures are cross folded by the cooperation of a folding blade on the collection and folding blade cylinder with jaws on a folding jaw cylinder. While various types of gripping devices are known in the art, one gripping arrangement utilizes a plurality of points or needles that essentially pierce the leading edge of the product web and then hold the cut signature on the collecting and folding blade cylinder. These points or needles move in a generally radial direction with respect to the collecting and folding blade cylinder.

One folding apparatus which consists of a cutting cylinder; a point, collecting and folding blade cylinder; and a folding jaw cylinder is shown in German Patent Publication DE 38 10 439 C1. In this prior art device, the leading edge of a printed web is directed between the cutting cylinder and the point, collecting and folding blade cylinder, hereinafter the conveying cylinder. This web leading edge is needled or pierced by the plurality of points disposed on the conveying cylinder and is then cut by the cooperation of the cutting blade cylinder and the cutting bar situated on the periphery of the conveying cylinder. This cutting of the printed web is accomplished at a location just downstream, in the direction of web travel, from the points. The newly created cut web sections or signatures are conveyed by, or collected on, the conveying cylinder and are subsequently transferred to the folding jaw cylinder. As the signatures are transferred to the folding jaw cylinder, the needles or points are retracted to release the signatures from the conveying cylinder. In this prior art device, the point tips which are used to pierce or needle the product to a depth dependent on the thickness of the product being handled, are caused to project from the peripheral surface of the point, collecting and folding blade cylinder or conveying cylinder by the operation of a spindle carried in the conveying cylinder, and by a plurality of point holder arms which are attached to the spindle. These point holder arms are arranged across the width of the conveying cylinder in an axially extending line with each point holder arm typically supporting one or several axially spaced point needles. The spindle is caused to rotate by a cam drive having a cam surface which engages a roller or roller lever on the end of the spindle. In the operation of this prior art conveying cylinder, the point tips of the point needles move over a portion of a curvature path around the axis of rotation of the spindle which is fixed in place on the conveying cylinder.

A disadvantage of this prior art folding apparatus is a result of the generally curved path which the point needles are caused to travel. This travel path dictates that the point needles must be situated at a relatively great distance away from the cutting bar. When the cutting blade and the cutting bar engage each other to cut the leading edge of the printed web, it is clear that they must have an unobstructed path. Any collision between the cutting edge of the cutting blade and a web gripping device, such as a point needle, will severely damage both the point needle and the cutting edge. In addition, the paper web will not be properly cut and the resultant signature will have a rough, torn edge instead of a smooth, cut edge. The point needles must therefore be spaced from the cutting bar at a distance sufficient to insure that they will not interfere with the operation of the cutting blade. When the point needles are located at a relatively large distance from the cutting bar, the result is a significant space between the cut edge of the signatures and the line of perforations formed by the point needles. This requires that the cut and folded signatures undergo an additional edge trimming or cutting step particularly in the instance of job or telephone directory printing. This additional cutting or trimming step severs the edge strip with the point holes from the product and must be done after the printing and folding has been accomplished. The requirement for this additional edge trimming step generates large amounts of waste or scrap paper and adds an additional step to the production process.

During the release of the now cut signatures from the conveying cylinder to the folding jaws of a folding jaw cylinder in the prior art device, another limitation results from the path of travel of the point tips. The ends of the signatures which are still held on the peripheral surface of the conveying cylinder by the points can be pulled out of the folding jaws if the point needles are retracted too late. It is also possible that the signatures can be pulled off the conveying cylinder or that point needles can be broken off. However, if the point needles on the conveying cylinder are retracted too early, the end of the signature located on the cylinder starts to flap. A so-called "whip effect" results and this can lead to the formation of "dog ears" and to a consequential reduction in the quality of the product.

It will be seen that a need exists for a gripping device and its method of operation which overcomes these limitations of the prior art. The method and apparatus for moving point needles in accordance with the present invention provides such a method and apparatus and is a significant improvement over the prior art.

SUMMARY OF THE INVENTION

It is an object of the present invention to provide a method and apparatus for moving point needles.

Another object of the present invention is to provide a method and apparatus for moving point needles in a conveying cylinder.

A further object of the present invention is to provide a method and apparatus for moving point needles in a conveying cylinder of a rotary printing press.

Still another object of the present invention is to provide a method and apparatus for moving point needles at the periphery of the conveying cylinder.

Yet a further object of the present invention is to provide a method and apparatus for moving point needles in which the needles penetrate the product web close to the cutting line of a cutting blade acting against the cutter bar.

As will be discussed in detail in the description of the preferred embodiments which is presented subsequently, the point needles are insertable into a leading edge of a product web just before or upstream of the point of cooperation between a cutting blade and a cutting bar which is part of the conveying cylinder that also includes the point needles. These point needles are arranged in point needle holders which are carried at the free ends of point holder arms. Each point needle holder performs a generally arcuate pivot movement so that the point needle tips will be moved from a base position inside of the periphery of the conveying cylinder to a center position outside of the periphery of the conveying cylinder. As the point needle tips travel from their base position to their center position along an extension curve, they pierce or needle the leading edge of the product web. The point needle tips are moved along their circular, arc-like curve course by the operation of a four lever assembly which superimposes a second pivot motion on the first pivot motion created by the point needle arms. This arc-like pivot motion is in the shape of a concave or compound curve such as one leg of a parabola. The four member swivel joint allows the point needle holders carried by the point needle holder arms to travel this compound curve path from a base point within the periphery of the conveying cylinder to an extended point which is generally quite close to the line of action of the cutting bar which severs the printed web into signatures.

A particular advantage of the method and apparatus for moving point needles in accordance with the present invention is that a shorter or smaller distance exists between the point holes and the cut edge of the printed product than was possible in the prior art devices. This is due to the circular or arc-like compound curve course which the point needle tips follow as they move from their inner, base position to their fully extended end position. This path allows the point needle tips to be inserted into the printed product web much closer to the cutting blade without hampering the cutting process. This is of particular advantage in connection with the printing of telephone directories and with job printing since it is possible to cut off a much narrower edge strip in the course of subsequent processing of the cut and folded signatures. This greatly reduces the amount of paper waste.

Another advantage of the method and apparatus for moving point needles in accordance with the present invention is that in the course of the transfer of the signatures from the point, collecting and folding blade cylinder or conveying cylinder to the folding jaw cylinder, the retraction of the point needle tips out of the signatures is made much easier. This movement of the point needle tips in the retraction direction with respect to the signature end which is still located on the surface of the conveying cylinder makes "un-needling" of the signatures, or retraction of the point needles, much easier. This reduces slitting of the point holes, damage to the needle points and pulling of the signatures out of the folding jaws of the folding jaw cylinder.

The method and apparatus for moving point needles in accordance with the present invention overcomes the limitations of the prior art. It is a substantial advance in the art.

BRIEF DESCRIPTION OF THE DRAWINGS

While the novel features of the method and apparatus for moving point needles in accordance with the present invention are set forth with particularity in the appended claims, a full and complete understanding of the invention may be had by referring to the detailed description of the preferred embodiments, as presented subsequently, and as illustrated in the accompanying drawings, in which:

DETAILED DESCRIPTION OF THE PREFERRED EMBODIMENTS

Figure 1:
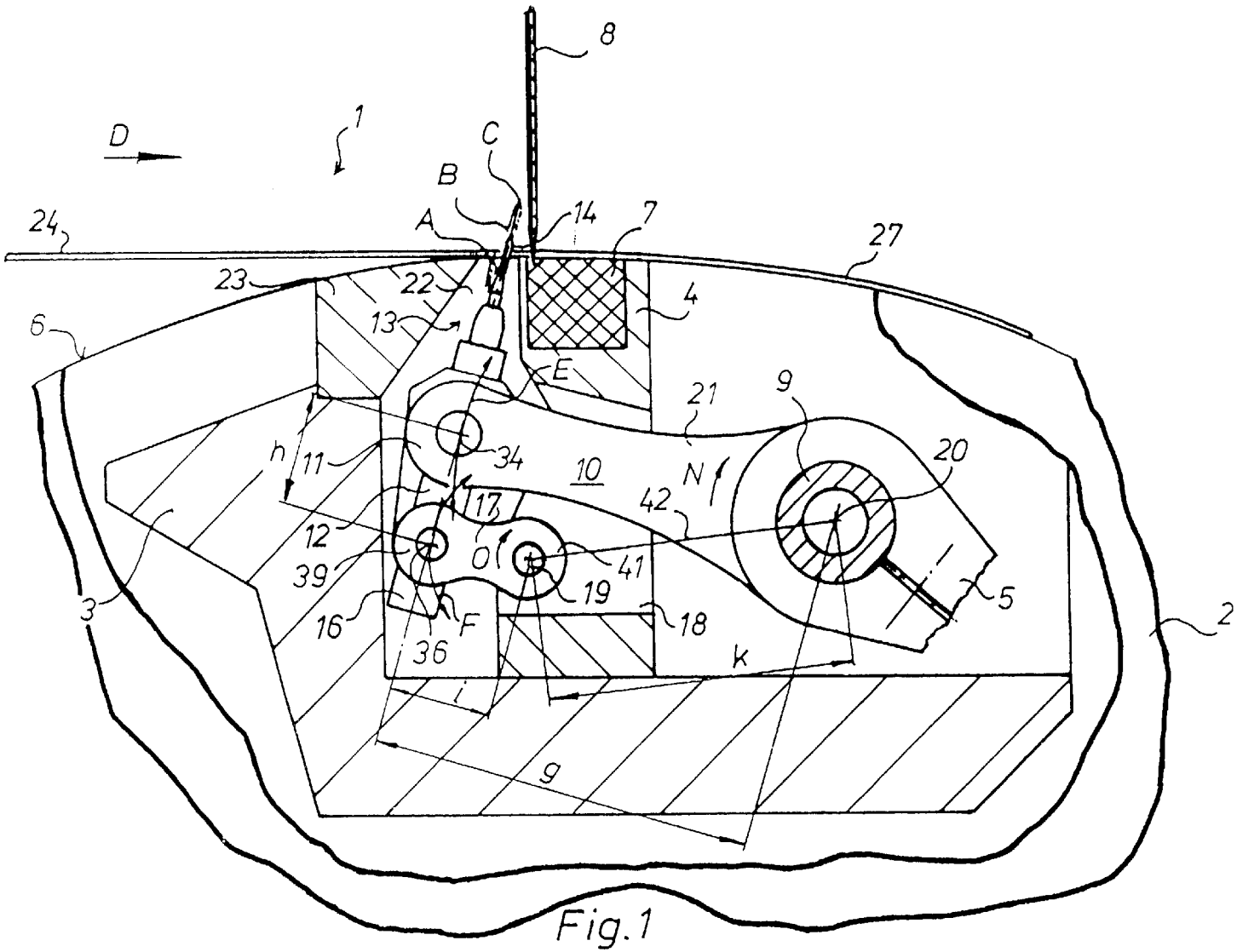
FIG. 1 is a schematic side-elevation view, partly in cross section and showing a portion of a first preferred embodiment of a conveying cylinder with the point drive in accordance with the present invention, and showing a cutting blade cooperating with a cutting bar of the conveying cylinder.

Referring initially to FIG. 1, there may be seen, generally at 1, a first preferred embodiment of a conveying cylinder which is usable in a web-fed, rotary printing press to receive a leading edge of a printed product or web, to cut the web into signatures, and to convey the cut signatures to a cooperating folding jaw cylinder. It will be understood that the printing press in which the conveying cylinder 1 is positioned, as well as the structure of the cutting blade cylinder and the folding jaw cylinder with which it cooperates are generally well known in the art and form no part of the present invention. Accordingly, they are not shown in the drawings or discussed in detail.

Again referring to FIG. 1, conveying cylinder 1 is a generally open cylinder whose structure is defined by spaced lateral disks 2, with only one such disk being shown, which are connected by several circumferentially spaced cross arms 3, only one of which is shown in FIG. 1. Conveying cylinder 1 is supported by suitable axle journals between spaced side frames of the press and is caused to be rotated by any suitable cylinder drive arrangement. Each of the cross arms 3 extends between the lateral disks 2 in a direction parallel to the axis of rotation of the conveying cylinder 1. Each of these cross arms 3 has a grooved bar 4 which receives an axially extending cutting bar 7. The cutting bar 7 is oriented toward the periphery 6 of the conveying cylinder 1. A cutting blade or cutter 8, that is carried by a cutting cylinder (not shown), is engageable with the cutting bar 7 to cut a continuous web 24 to thereby form a leading end. The cooperation of the cutting bar 7 and the cutting blade 8 cuts the web 24 and forms a plurality of signatures 27 which are held on the periphery 6 of the conveying cylinder 1 and which are then cross folded by the operation of a folding blade on the conveying cylinder with folding jaws of a folding jaw cylinder.

A control spindle 9 is rotatably supported in both lateral disks 2, and, in turn, supports a plurality of axially spaced point holder arms 10, with each such point holder arm 10 being embodied as a first rocker of a length "g". Each point holder arm 10 respectively functions as a first rocker of a level four-member swivel joint which will be discussed in detail shortly.

The several axially spaced point holder arms 10 are fastened on the control spindle 9 at their respectively first ends 21. The control spindle 9 is connected with at least one drive unit 5. This drive unit 5 can consist of a roller lever, not shown, which is frictionally or interlockingly connected with a control cam fixed on the cylinder 1. It is also possible to provide a separate support, fixed on the cylinder 1, for the first end 21 of each one of the point holder arms 10 in place of the control spindle 9. In this case, each point holder arm 10 would be separately driven, for example, by a cam drive or a gear wheel drive. Each individual drive unit can be operated by means of an electric motor which can be synchronized with the other drive motors for the other point holder arms 10.

On its second end 11, which is remote from the control spindle 9, each point holder arm 10 supports a point needle holder 12, which is pivotable around a point holder arm shaft 34. Each point needle holder 12 is used as a coupler of the previously mentioned swivel joint. Each point needle holder 12 has a point needle 14 on its upper or radially outer end 13 facing the periphery 6 of the cylinder 1. It is also possible to employ each point needle 14 itself as the coupler or point needle holder 12. It is furthermore also possible to dispose the point needle 14, not at the outer end 13 of the point needle holder 12, but to fasten it, extending parallel with the longitudinal axis of the point needle holder 12, on the point needle holder 12. On its lower or radially inner end 16 remote from the point needle 14, the point needle holder 12 is hingedly connected by means of its point needle holder shaft 36, disposed at a distance "h" from the point holder arm shaft 34, with a second end 39 of a second rocker 17. This second rocker 17 is seated fixed in place in the groove bar 4 and therefore is also fixed in place on the lateral disk 2. The bar 4, supported by the cross arm 3 and fastened to the lateral disks 2, has one hole or aperture 18 for each point holder arm 10 and a bolt 19, fixed in place on the bar 4, for the rotatable reception of a first end 41 of the second rocker 17. The number of holes 18 corresponds to the number of point needles 14. The second rocker 17 is of a length "i". This rocker length "i" is shorter than the length "g" of the point holder arm 10.

Figure 3:
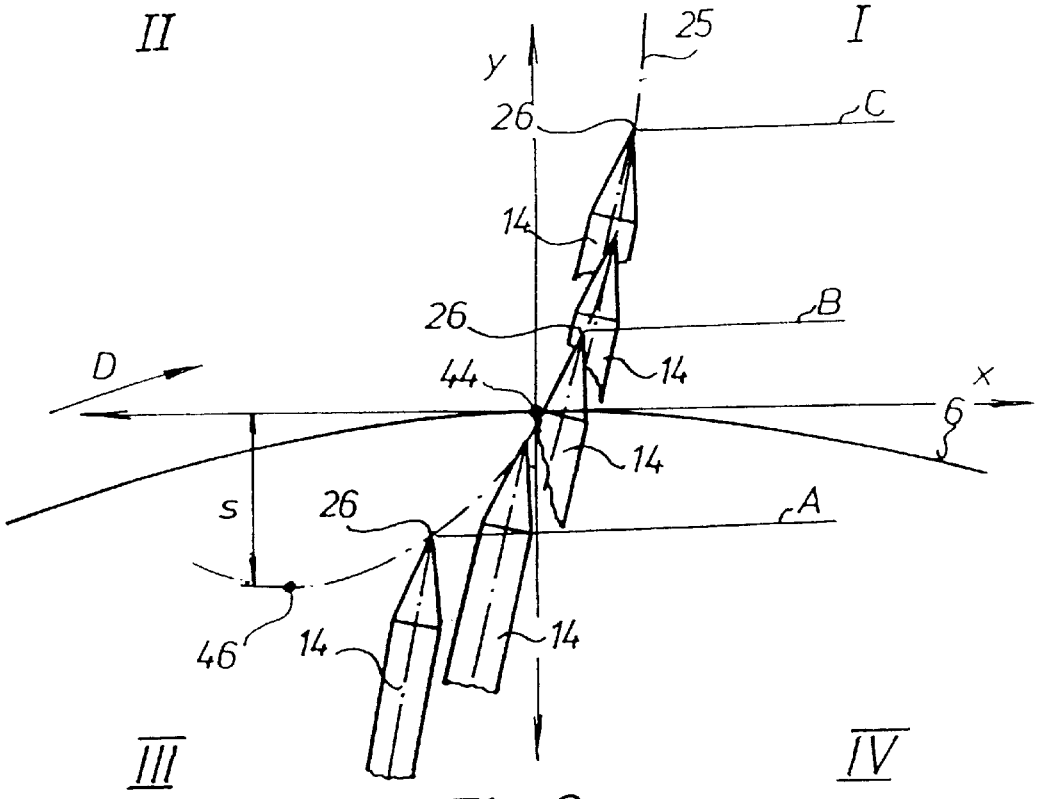
FIG. 3 is a schematic depiction of the curve of the movement course of a point needle tip in accordance with the point drive shown in FIG. 1.

It would also be possible to fasten the first end 41 of the second rocker 17 on a spindle, seated fixed in the lateral disks on both ends, in place of on the bolt 19 fixed on the bar 4. A connecting line 42 drawn between a pivot shaft 20 of the control spindle 9, seated fixed on the lateral disk, and a bolt 19 or a shaft, fixed in place on the lateral disk 2, of the second rocker 17, is of a length "k". In this way, the point needle holder 12 acts as a coupler between the first and second rockers 10 and 17, respectively. A tip 26 of each point needle 14, as seen in FIG. 3, is structured as a cap on each point needle holder 12 or coupler. With the movement of the point holder arm 10, the point needle 14 emerges through a slit 22 extending in an axis-parallel direction out of the periphery 6 of the cylinder 1. A cover bar 23 is located next to the slit 22, as may be seen in FIG. 1.

In accordance with this first preferred embodiment of the present invention, the device for needling a paper web 24 is constructed as a level, four-member swivel joint which comprises point holder arm 10, needle holder 12, second rocker 17 and pivot shafts 19 and 20. The pivot shafts 19 and 20, which are disposed at a distance "k" from each other are fixed in place on the lateral disks 2, of the rocker 17, or of the rocker or the point holder arm 10. It is also possible, in accordance with the first embodiment to exchange the spindle 9 with the bolt 19 of the second rocker 17, and thus to provide the drive of the four-member swivel point gear by the first end 41 of the second rocker 17.

As may be seen most clearly in FIG. 3, in a first step A-44-B of a needling movement A-44-B-C, along a compound arc-shaped course curve 25 during which the point needles 14 come from their lower end position A, and move with their needle tips 26 past the periphery 6 of the cylinder 1 into a center position B located in the immediate vicinity of the cutting bar 7, the paper web 24 moving in the production direction D is needled and is subsequently transversely cut by the cutter 8 acting against the opposite cutting bar 7 of the cylinder 1, as is shown in FIG. 1. Following the completed transverse cutting process of the paper web 24 by the cutter 8 and the start of the separating movement between the point needles 14 and the cutting edge of the cutter 8, the needle tips 26 of the point needles 14 continue to move along their compound arc-shaped course curve 25 into their upper end position C. In the process, the needle tips 26 have traveled their greatest distance after leaving the periphery 6 of the conveying cylinder 1. During this movement of the point needles 14 from their center position B into their upper end position C, only small additional forces have an effect on the products, because of which slitting of the point holes is prevented. In the same way, a signature 27 created in this way is protected against an automatic "un-needling" on the cylinder 1.

In the process for moving point needles 14 in accordance with the present invention, the needle tips 26 of the point needles 14 move along a compound arc-shaped course curve 25 which is convex in relation to the first pivot shaft 20, as seen in FIG. 3, with this compound course curve 25 being based on a first pivot movement E of the point holder arm 10 pivoting around the first pivot shaft 20 fixed in place on the cylinder, and the superposition of the second pivot movement F acting on the point needle holder 12 during needling as well as during un-needling. Viewed from the direction of rotation D of the cylinder 1, the point needle tips 26 essentially perform a concave movement compound course curve 25. In this first preferred embodiment, the movement course curve 25 has a first shallow rise between the lower end position A and an intersection point 44 with the periphery 6 of the cylinder 1, the slope of which lies, for example, between 0.3 and <1.0 measured as a tangent of the rise angle. After the intersection point 44, the movement course curve 25 extending between the periphery 6 and the upper end position C shows a steep rise which is >1.0. The rise of the movement course curve 25 between the intersection point 44 and the center position B can lie between >1.0 and 4 in this portion of the curve 25.

The movement course curve 25 can have the shape of an arc of a circle or of a branch of a parabola which extends through the Ist and IIIrd or the IInd and IVth quadrants of a right-angled coordinate system, depending on the construction of the cylinder 1. An intersection point 44 of the curve 25 with the periphery 6 of the cylinder 1 in this case also constitutes the intersection point of the X-axis with the Y-axis, as seen in FIG. 3. A vertex 46, for example of the branch of the parabola, in this case is located in the IIIrd quadrant at a distance S from the X-axis of the right-angled coordinate system as is shown in FIG. 3. The movement course curve 25 can further extend, for example in accordance with a function y=−c−coth x, not shown, wherein a constant c>1 and wherein coth is the hyperbolic cotangent.

In contrast to the previously described movement course curve 25 embodied as an arc of a circle or a branch of a parabola, this movement course curve 25 exhibits a shallower rise between the points A-44 and a steeper rise between the points 44-B. Subsequently, a retracting movement C-B-44-A of the point needle tips 26 from the upper end position C through the center position B, and to the lower end position A inside the periphery 6 of the cylinder 1 takes place corresponding to the above mentioned movement course curve 25 of the cylinder 1.

The curve course 25 of the needle tips 26 depends on the lengths as well as on the arrangement of the individual members 10, 12, 17 and 19 and 20 of the level four-member swivel joint. A pivot direction N of the first pivot movement E of the first rocker 10 is in the same direction as that of a pivot direction O of the superimposed second pivot movement F of the second rocker 17.

The retracting movement of the point needle tips 26 of the point needles 14 takes place from the center position B into the base position A preferably in the already described concave movement, now falling in relation to the position of the point needle holder 12. In the process, not only does a retraction of the needle tips 26 below the periphery 6 of the cylinder 1 take place, but, at the same time, a movement of the needle tips 26 in the retraction direction of the end of the already folded signature 27 takes place, i.e. in a direction opposite to the direction of rotation D of the conveying cylinder 1. In this way, the circumferential speed of the point needles 14 is reduced during this period of needle retraction, which assures a qualitatively correct transfer of the printed product to a second cylinder, for example the folding jaw cylinder.

Figure 2:
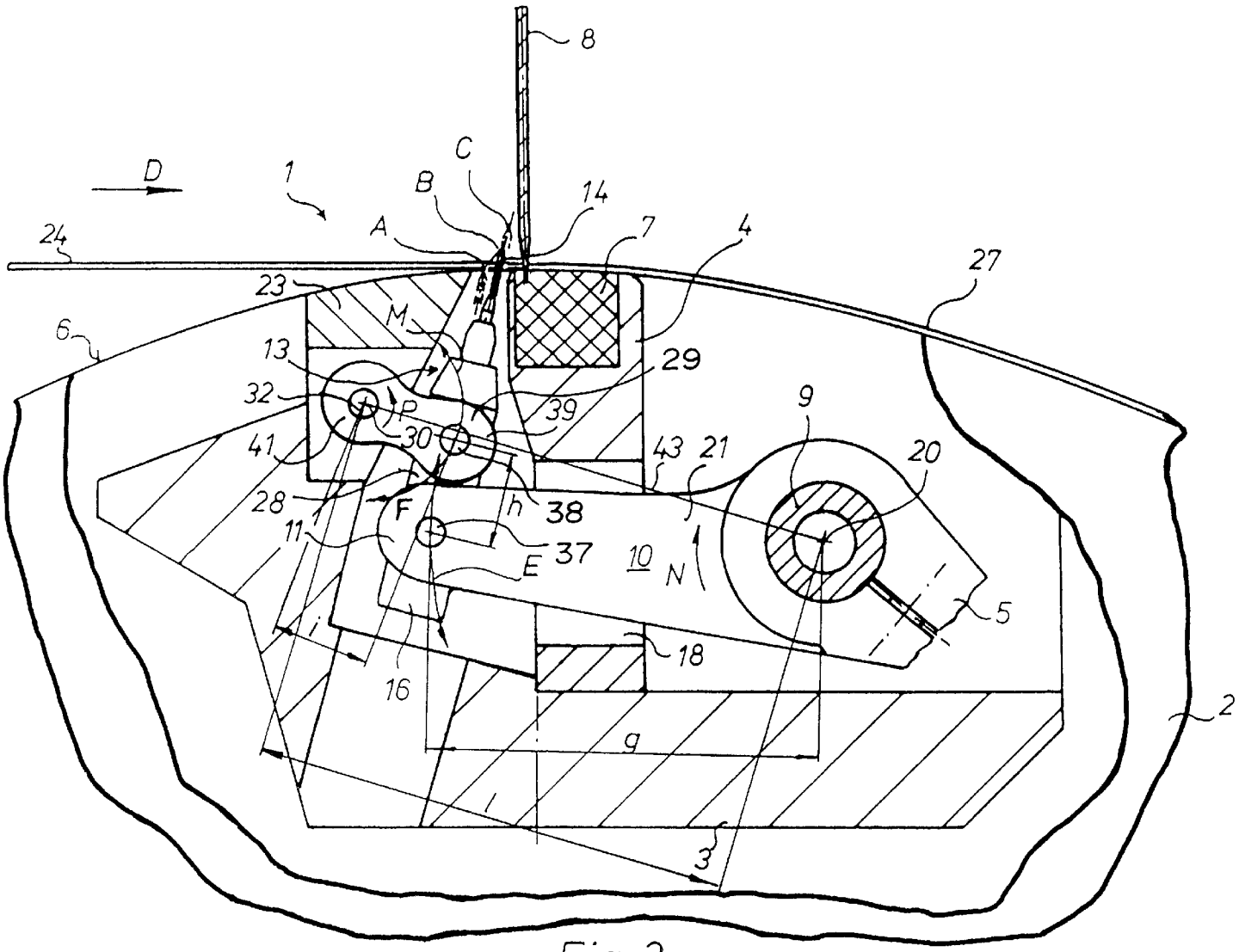
FIG. 2 is a schematic side-elevation view, generally similar to FIG. 1 and showing a second preferred embodiment of the point drive in accordance with the present invention.
Figure 4:
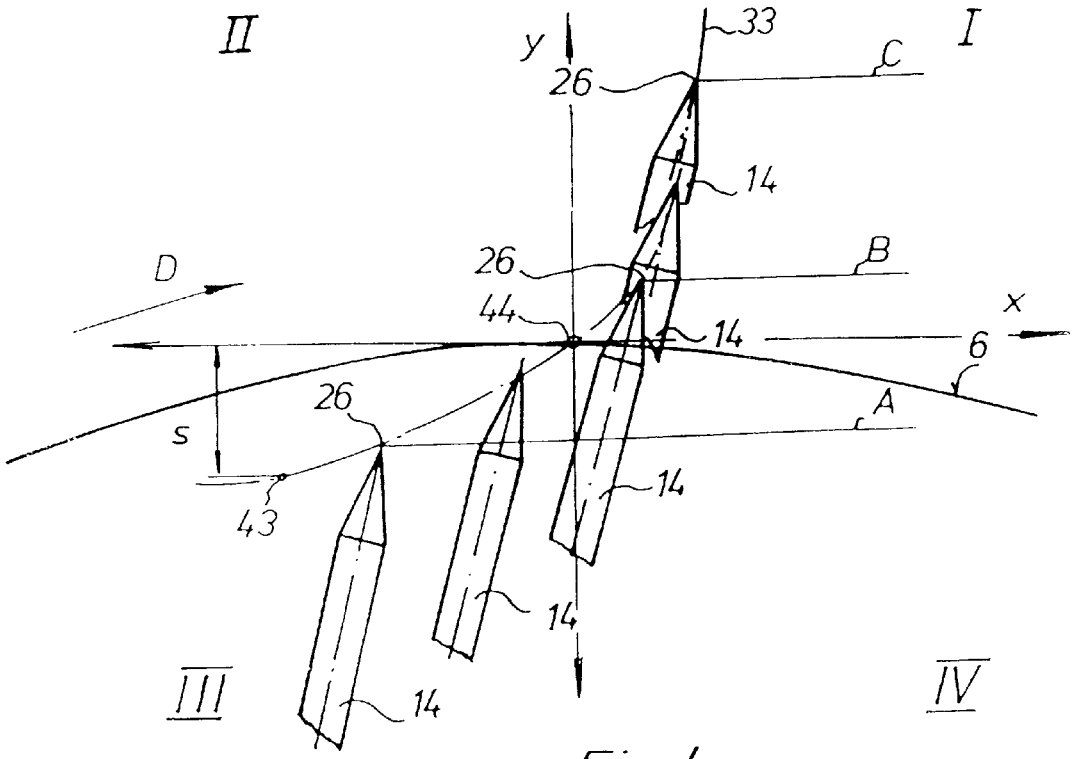
FIG. 4 is a schematic depiction of the curve of the movement course of a point needle tip in accordance with the point drive shown in FIG. 2.

In a second preferred embodiment of a device for moving point needles in accordance with the present invention, as seen in FIGS. 2 and 4, the second end 11 of the first rocker or the point holder arm 10 is hingedly connected around a point holder arm shaft 37 with the end 16 of a point needle holder 28, remote from the point needle 14, functioning as a coupler, which is different in structure from the device depicted in FIG. 1, but which is similar in function. The upper end 13, close to the point needle 14, of the point needle holder 28, is hingedly connected by means of a point needle holder shaft 38 with the second end 39 of a second rocker 29 which is seated fixed on the lateral disk 2 at its first end 41. In this case, the first end 41 of the second rocker 29 is seated on a spindle 32, fixed in place on the lateral disk 2. The spindle 32 acts as a pivot shaft 30.

A connecting line 43 drawn between a pivot shaft 20 of the control spindle 9, which is fixed on the lateral disk 2, and the pivot shaft 30, which is also fixed on the lateral disk 2, of the second rocker 29 is of a length l. l>g; l>>h; l>>i applies to the length l wherein, as seen in FIG. 3 g is the distance between shafts 29 and 37; h is the distance between shafts 37 and 38; and i is the distance between shafts 37 and 30.

Similar parts have been provided with the same reference numerals and have the same functions in both of the two embodiments. This, too, is a four-member swivel joint which comprises point holder arm 10, point needle holder 28, second rocker 29 and pivot shafts 20 and 30. The pivot shafts 20 and 30 are fixed on the lateral disks 2, of the control spindle 9 or the spindle 32. Here, too, is it possible to provide the drive of the four-member swivel joint via the first end 41 of the rocker 29.

The function of the device set forth in this second preferred embodiment is analogous to that set forth in the first preferred embodiment with respect to the first pivot movement E of the point holder arm 10 and the control or second pivot movement F superimposed on the first pivot movement and performed by the second rocker 29. A compound course curve 33 of the needle tips 26 of the point needles 14 for the second preferred embodiment is represented in FIG. 4 and essentially corresponds to that discussed in accordance with FIG. 3. The compound movement course curve 33 of FIG. 4 is a function of the size, arrangement and distances between the individual members of the level four-member swivel joint. The course curve 33 shown in FIG. 4 also applies in the opposite direction, i.e. from C to A via B, for the retraction of the point needles 14 below the periphery 6 of the cylinder 1. A vertex 43 of the movement course curve 33, which may be, for example a branch of a parabola, also is located at a distance s of, for example, three to eight millimeters, from the X-axis of a right-angled coordinate system. A pivot direction P of the superimposed second pivot movement M of the second rocker 29 is opposite to a pivot direction N of the first pivot movement E of the first rocker 10 in this second preferred embodiment.

Starting at their emergence from the periphery 6 of the conveying cylinder 1 until the maximum position C of the needle tips 26, the needle tips 26 of the point needles 14 travel a distance of five to fifteen mm, preferably eleven millimeters with thick products, measured in the radial direction of the cylinder 1. A radial distance from the base position A to the center position B of the needle tips 26 corresponds to two-thirds of the radial distance of the needle tips A to the maximum position C.

While preferred embodiments of a method and apparatus for moving point needles in accordance with the present invention have been set forth fully and completely hereinabove, it will be apparent to one of skill in the art that a number of changes in, for example, the overall size of the cylinder, the specific type of rotary printing press, the drive for the cylinder and the like could be made without departing from the true spirit and scope of the present invention which is accordingly to be limited only by the following claims.

What is claimed is:

1. A cylinder for conveying signatures in a folding apparatus of a rotary press comprising:

a plurality of point needles positioned adjacent a peripheral surface of said conveying cylinder; and a level four-member swivel joint including a coupler for driving each of said point needles along a course curve, said level four-member swivel joint including a first rocker and a second rocker which are each pivotably secured on said cylinder at their respective first ends at a first distance from each other and further wherein second ends of each of said first and second rockers are pivotably connected to said coupler at a second distance from each other.

2. The cylinder of claim 1 wherein said point needles are carried by point needle holders and further wherein each said point needle holder is said coupler of said level four-member swivel joint.

3. The cylinder of claim 2 wherein said point needles are fastened to an end of said coupler adjacent said peripheral surface of said cylinder.

4. The cylinder of claim 1 wherein each of said point needles is said coupler of said level, four-member swivel joint.

5. The cylinder of claim 1 wherein said first and second rockers have different lengths.

6. The cylinder of claim 1 wherein one of said first and second rockers is drivable.

7. The cylinder of claim 1 wherein said first rocker is movable in a first pivot direction and further wherein said second rocker is movable in a second pivot direction.

8. The cylinder of claim 7 wherein said first and said second pivot directions are the same.

9. The cylinder of claim 7 wherein said first and said second pivot directions are opposite to each other.

* * * * *